US010573260B2

(12) United States Patent
Tominaga

(10) Patent No.: US 10,573,260 B2
(45) Date of Patent: Feb. 25, 2020

(54) DISPLAY DEVICE

(71) Applicant: Sharp Kabushiki Kaisha, Sakai, Osaka (JP)

(72) Inventor: Masakatsu Tominaga, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/115,632

(22) Filed: Aug. 29, 2018

(65) Prior Publication Data

US 2019/0073968 A1 Mar. 7, 2019

(30) Foreign Application Priority Data

Sep. 1, 2017 (JP) ..... 2017-168844

(51) Int. Cl.
*G09G 3/36* (2006.01)

(52) U.S. Cl.
CPC ... *G09G 3/3607* (2013.01); *G09G 2300/0452* (2013.01); *G09G 2310/0232* (2013.01); *G09G 2320/0233* (2013.01); *G09G 2320/0242* (2013.01); *G09G 2320/0686* (2013.01)

(58) Field of Classification Search
CPC ..... G09G 3/3607
USPC ..... 345/55, 83, 89, 107, 211, 594, 694
See application file for complete search history.

(56) References Cited

U.S. PATENT DOCUMENTS 5,739,809 A * 4/1998 McLaughlin ..... G06F 3/04842 345/594
8,232,943 B2 * 7/2012 Park ..... G09G 3/3607 345/100
8,300,072 B2 * 10/2012 Lee ..... G09G 3/344 345/107
2006/0125942 A1 * 6/2006 Hosaka ..... G09G 3/3413 348/308
2007/0052636 A1 * 3/2007 Kalt ..... G09G 3/34 345/83
2008/0074371 A1 * 3/2008 Tajiri ..... G09G 3/3659 345/89
2008/0278468 A1 * 11/2008 Hosaka ..... G09G 3/2029 345/205

(Continued)

FOREIGN PATENT DOCUMENTS

JP 2006-276359 A 10/2006
JP 2006-276580 A 10/2006

(Continued)

*Primary Examiner* — Prabodh M Dharia
(74) *Attorney, Agent, or Firm* — Keating & Bennett, LLP

(57) ABSTRACT

A display device includes a non-rectangular display panel with an array of pixels, each pixel includes subpixels corresponding to at least three different colors, respectively, a driver that supplies gray level signals to the display panel, and a plurality of data lines that supply the gray level signals to the subpixels, respectively. A display-contributing effective area of one of the subpixels of one of the colors in boundary pixels is different from a display-contributing effective area of one of the subpixels of one of the colors in non-boundary pixels. The driver supplies the gray level signals for the respective subpixels to the data lines based on a ratio of the display-contributing effective area of the subpixels in the non-boundary pixels to the display-contributing effective area of the subpixels in the boundary pixels.

5 Claims, 10 Drawing Sheets

(56) References Cited

U.S. PATENT DOCUMENTS

| | | | | |
|---|---|---|---|---|
| 2009/0115933 | A1 | 5/2009 | Mimura | |
| 2009/0195481 | A1 | 8/2009 | Taguchi et al. | |
| 2009/0309813 | A1* | 12/2009 | Fujita | G02F 1/133512 345/55 |
| 2010/0020277 | A1 | 1/2010 | Morita | |
| 2010/0141874 | A1 | 6/2010 | Morita | |
| 2011/0292018 | A1* | 12/2011 | Kubota | G09G 3/3426 345/211 |
| 2012/0001835 | A1* | 1/2012 | Yamamoto | G02F 1/13454 345/55 |
| 2017/0249911 | A1* | 8/2017 | Ito | G09G 3/3688 |
| 2018/0231837 | A1* | 8/2018 | Fukuoka | F21S 2/00 |

FOREIGN PATENT DOCUMENTS

| | | | |
|---|---|---|---|
| JP | 2009-180961 | A | 8/2009 |
| JP | 2009-300556 | A | 12/2009 |
| JP | 2010-032638 | A | 2/2010 |
| JP | 2010-134361 | A | 6/2010 |
| WO | 2007/132574 | A1 | 11/2007 |

* cited by examiner

DISPLAY DEVICE

TECHNICAL FIELD

The present invention relates to a display device.

BACKGROUND ART

In recent years, a display device has been used in a variety of devices such as, not only a television and a personal computer, but also a mobile phone, a car navigation system, a game machine and the like. The display device, therefore, has a display area in a non-rectangular shape such as a circular shape, an oval shape, or the like in some cases, instead of a rectangular shape, depending on the device type (see Patent Document 1).

PRIOR ART DOCUMENT

Patent Document

Patent Document 1: JP-A-2006-276359

SUMMARY OF THE INVENTION

Problem to be Solved by the Invention

In a display device having a display area in a non-rectangular shape, respective subpixels of red (R), green (G), blue (B) of a pixel arranged in a boundary part of the display area (hereinafter referred to as boundary pixels) do not have identical display-contributing, effective areas to those of respective subpixels of R, G, and B of a pixel arranged in a part of the display area other than the boundary part (hereinafter referred to as non-boundary pixels). When white color display is performed, pixels in the boundary part of the display area lose color balance, and become defectively colored, thereby causing the display quality to decrease.

It is an object of the present invention to provide techniques with which the deterioration of the display quality such as defective coloring and the like can be suppressed in a display device having a display area in a non-rectangular shape.

Means to Solve the Problem

A display device in one embodiment of the present invention includes a display panel having a display area in a non-rectangular shape; and a driving unit that supplies gray level signals to the display panel, the gray level signals indicating gray levels of an image to be displayed in the display area. In the display device, the display area includes: a pixel group in which a plurality of pixels are arrayed, each pixel being composed of subpixels corresponding to at least three different colors, respectively; and a plurality of data lines that supply the gray level signals to the subpixels of the pixel group, respectively. The pixel group includes a plurality of boundary pixels provided at a boundary of the display area, and a plurality of non-boundary pixels provided in an area other than the boundary, in part of the boundary pixels, a display-contributing effective area of the subpixels of at least part of the colors, among the subpixels in the boundary pixels, is different from an effective area of the subpixels in the non-boundary pixels, and the driving unit supplies the gray level signals for the respective subpixels to the data lines, based on a ratio of the effective area of the subpixels in the non-boundary pixels with respect to the effective area of the subpixels of the at least part of the colors in the boundary pixels.

Effect of the Invention

With the present invention, the deterioration of the display quality such as defective coloring and the like can be reduced in a display device in a non-rectangular shape.

MODE FOR CARRYING OUT THE INVENTION

Figure 1:
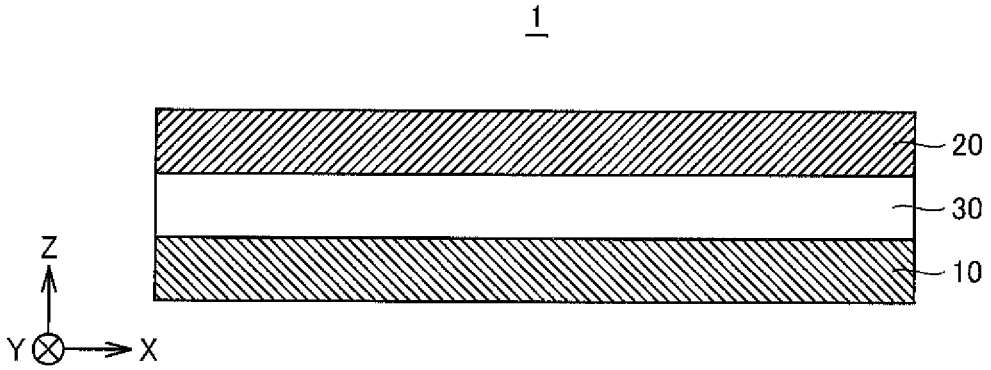
FIG. 1 is a cross-sectional view illustrating a schematic configuration of a display device in Embodiment 1.

A display device in one embodiment of the present invention includes a display panel having a display area in a non-rectangular shape; and a driving unit that supplies gray level signals to the display panel, the gray level signals indicating gray levels of an image to be displayed in the display area. In the display device, the display area includes: a pixel group in which a plurality of pixels are arrayed, each pixel being composed of subpixels corresponding to at least three different colors, respectively; and a plurality of data lines that supply the gray level signals to the subpixels of the pixel group, respectively. The pixel group includes a plurality of boundary pixels provided at a boundary of the display area, and a plurality of non-boundary pixels provided in an area other than the boundary, in part of the boundary pixels, a display-contributing effective area of the subpixels of at least part of the colors, among the subpixels in the boundary pixels, is different from an effective area of the subpixels in the non-boundary pixels, and the driving unit supplies the gray level signals for the respective subpixels to the data lines, based on a ratio of the effective area of the subpixels in the non-boundary pixels with respect to the effective area of the subpixels of the at least part of the colors in the boundary pixels (the first configuration).

According to the first configuration, in part of the boundary pixels in the display area in the non-rectangular shape, an effective area of the subpixels of at least part of the colors is different from an effective area of the subpixels of the non-boundary pixels. Gray level signals with respect to the respective subpixels are set according to the ratio of the effective area of the subpixels of the part of the boundary pixels with respect to the effective area of the subpixels of the non-boundary pixels. When the same color is displayed on the boundary pixels and the non-boundary pixels, therefore, the color balance of the pixels is hardly lost, and the deterioration of the display quality such as defective coloring and the like hardly occurs, as compared with a case where a gray level signal corresponding to the color is uniformly supplied to each subpixel.

The first configuration may be further characterized in that the effective area of the subpixels of the at least part of the colors in the part of the boundary pixels is smaller than the effective area of the subpixels in the non-boundary pixels corresponding to the at least part of the colors, and when causing the subpixels of the at least part of the colors in the part of the boundary pixels, and the subpixels in the non-boundary pixels, to display an image of the same color, the driving unit supplies the gray level signals so that the subpixels in the non-boundary pixels have a brightness lower than a brightness of the subpixels of the at least part of the colors in the part of the boundary pixels (second configuration). With the second configuration, a brightness difference hardly occurs between the boundary pixels and the non-boundary pixels, and defective coloring during white color display hardly occurs, as compared with a case where a gray level signal corresponding to the same color is uniformly supplied to each pixel.

The first configuration may be further characterized in that the effective area of the subpixels of the at least part of the colors in the part of the boundary pixels is larger than the effective area of the subpixels in the non-boundary pixels corresponding to the at least part of the colors, and when causing the subpixels of the at least part of the colors in the part of the boundary pixels, and the subpixels in the non-boundary pixels, to display an image of the same color, the driving unit supplies the gray level signals so that the subpixels of the at least part of the colors in the part of the boundary pixels have a brightness lower than a brightness of the subpixels in the non-boundary pixels (the third configuration). With the third configuration, a brightness difference hardly occurs between the boundary pixels and the non-boundary pixels, and defective coloring during white color display hardly occurs, as compared with a case where a gray level signal corresponding to the same color is uniformly supplied to each pixel.

Any one of the first to third configurations may be further characterized in that, when causing the subpixels of the at least part of the colors in the part of the boundary pixels, and the subpixels in the non-boundary pixels corresponding to the at least part of the colors, to display the same color, the driving unit supplies the gray level signals so that a brightness difference among the respective subpixels is within a predetermined range (the fourth configuration). With the fourth configuration, a brightness difference between the boundary pixels and the non-boundary pixels is less visible.

Any one of the first to fourth configurations may be further characterized in that the display panel includes a liquid crystal layer in the pixel group (the fifth configuration).

A display device according to one embodiment of the present invention includes a display panel having a display area, and a driving unit that supplies gray level signals to the display panel, the gray level signals indicating gray levels of an image to be displayed in the display area. The display area includes a pixel group in which a plurality of pixels are arrayed, each pixel being composed of subpixels corresponding to at least three different colors, respectively, and a plurality of data lines that supply the gray level signals to the subpixels of the pixel group, respectively. A display-contributing effective area of the subpixels of part of the pixel group is different from an effective area of the other subpixels corresponding to the same color as the color of the subpixels of the part, and the driving unit supplies the gray level signals for the respective subpixels to the data lines, based on a ratio of the effective area of the other subpixels with respect to the effective area of the subpixels of the part (the sixth configuration).

According to the sixth configuration, an effective area of the subpixels of part of the display area is different from an effective area of the other subpixels corresponding to the same color as the color of the subpixels of the part, and the gray level signal for each subpixel is set according to the ratio between the effective area of the subpixels of the part and the effective area of the other subpixels. When the same color is displayed on the pixels including the subpixels of the part and the other pixels, therefore, the color balance of the pixels is hardly lost, and the deterioration of the display quality such as defective coloring and the like hardly occurs, as compared with a case where a gray level signal corresponding to the color is uniformly supplied to each subpixel.

The following description describes embodiments of the present invention in detail, while referring to the drawings. Identical or equivalent parts in the drawings are denoted by the same reference numerals, and the descriptions of the same are not repeated. To make the description easy to understand, in the drawings referred to hereinafter, the configurations are simply illustrated or schematically illustrated, or the illustration of some of constituent members is omitted. Further, the dimension ratios of the constituent members illustrated in the drawings do not necessarily indicate the real dimension ratios.

Embodiment 1

FIG. 1 is a cross-sectional view illustrating a schematic configuration of a display device in the present embodiment. A display device 1 includes, as a display panel 2, an active matrix substrate 10, a counter substrate 20, and a liquid crystal layer 30 interposed between the active matrix substrate 10 and the counter substrate 20. Though the illustration is omitted in this drawing, the display device 1 includes a backlight that is provided so as to extend in a surface direction of the active matrix substrate 10, on a side opposite to the liquid crystal layer 30, and a pair of polarizing plates between which the active matrix substrate 10 and the counter substrate 20 are interposed. The following description describes a specific configuration of the active matrix substrate 10 and the counter substrate 20.

Figure 2:
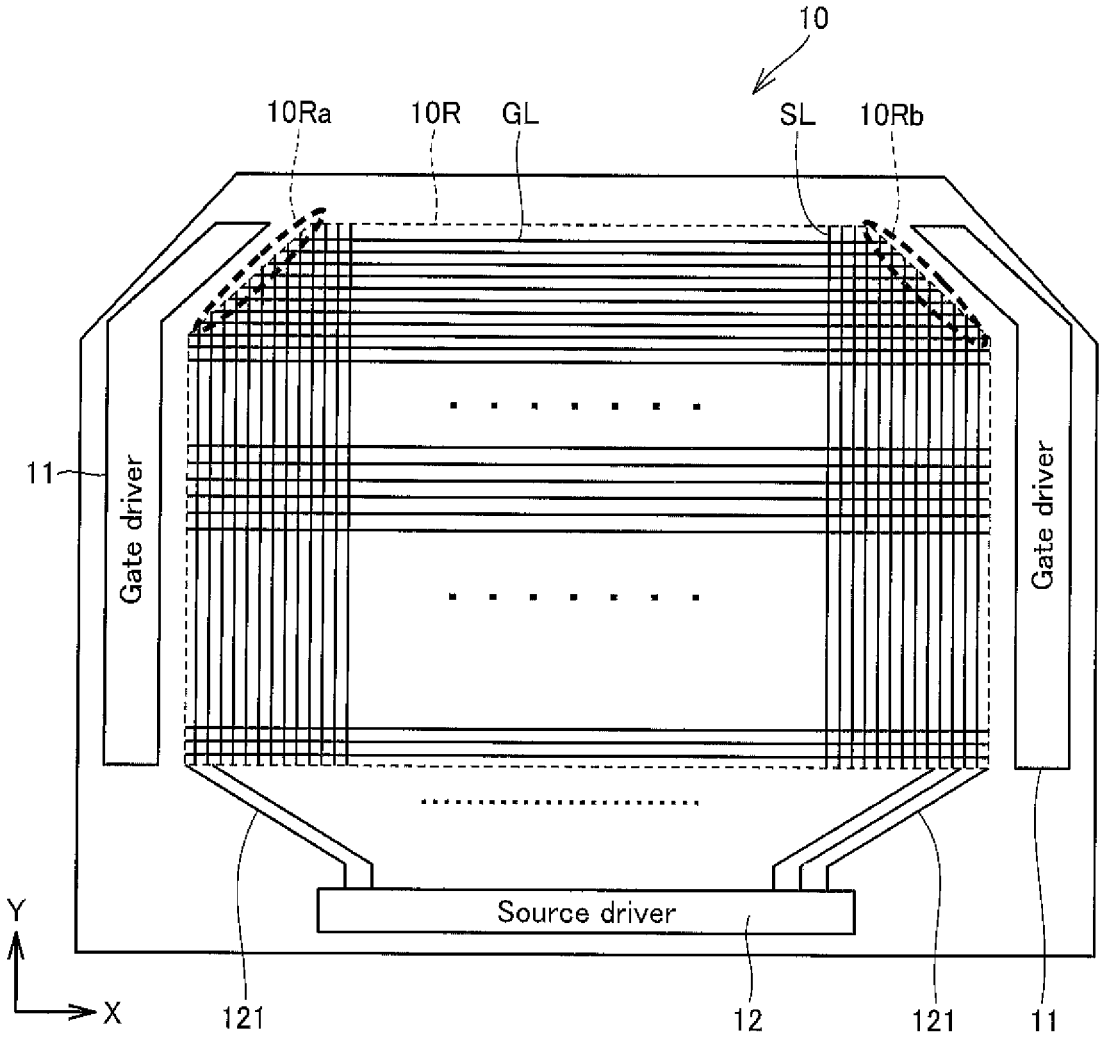
FIG. 2 is a plan view illustrating a schematic configuration of the active matrix substrate illustrated in FIG. 1.

FIG. 2 is a plan view illustrating a schematic configuration of the active matrix substrate 10. As illustrated in FIG. 2, the active matrix substrate 10 has a non-rectangular shape formed with a short side and a long side parallel to the X axis, and two sides parallel to the Y axis that are connected to the foregoing short and long sides. In this example, each side of the outer shape of the active matrix substrate 10 is straight.

The active matrix substrate 10 includes a plurality of gate lines GL, a plurality of source lines (data lines) SL, gate drivers 11, and a source driver 12.

On the active matrix substrate 10, a display area 10R is formed that includes a pixel group composed of subpixels that are defined by a plurality of gate lines GL and a plurality of source lines SL. The display area 10R is formed in the following manner so as to have a non-rectangular shape identical to the shape of the active matrix substrate 10: some of the gate lines GL provided on a side in the positive direction of the Y axis of the active matrix substrate 10 are shorter than the other gate lines GL, and the source lines SL that intersect with these gate lines GL are shorter than the other source lines SL.

Hereinafter, in FIG. 2, regarding boundary pixels provided along boundaries of the display area 10R, pixel regions 10Ra, 10Rb provided in the vicinities of ends of the gate lines GL having smaller lengths than those of the other gate lines GL are referred to as corner pixel regions 10Ra, 10Rb. Further, a pixel region for the pixels other than the boundary pixels is referred to as a non-boundary pixel region.

The two gate drivers 11 are provided on both ends of the gate lines GL outside the display area 10R, and each gate driver 11 is connected with the gate lines GL via signal lines (not shown), respectively. Each gate driver 11 includes a plurality of shift registers (not shown) that scan the gate lines GL, respectively.

The source driver 12 is provided on a side of the long side parallel to the X axis, outside the display area 10R. The source driver 12 is connected with the source lines SL via lines 121, respectively, and supplies signals indicating gray levels of an image to be displayed (hereinafter referred to as gray level voltage signals), to the source lines SL, respectively.

Though the illustration is omitted in FIG. 1, the counter substrate 20 includes of a plurality of color filters of three colors, i.e., red (R), green (G), and blue (B), and includes a black matrix provided in areas where the color filters are not arranged. The color filters of R, G, and B are arrayed in a predetermined order at positions opposed to the pixels in the display area 10R, respectively.

Figure 3:
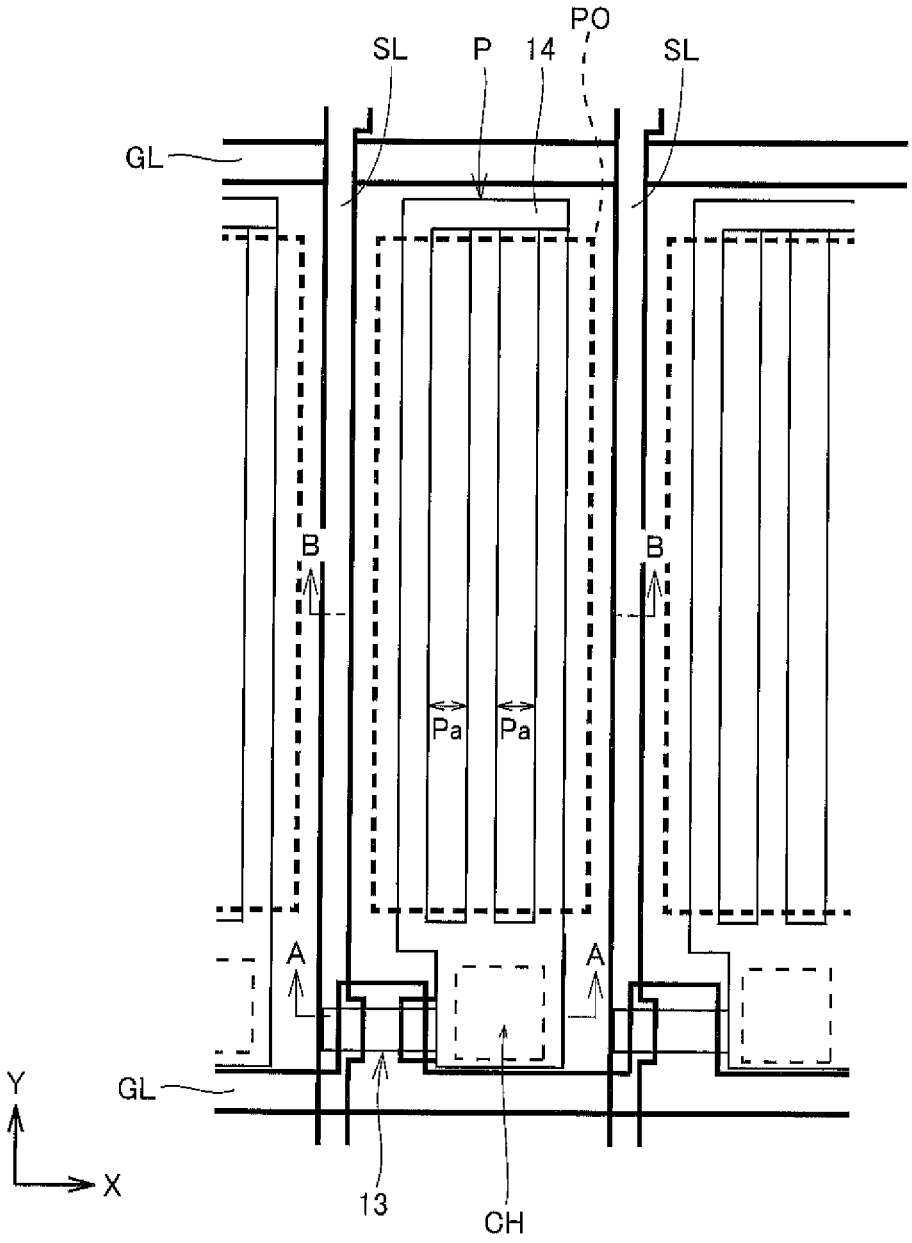
FIG. 3 is an enlarged plan view illustrating subpixels of a part of the display area illustrated in FIG. 2.
Figure 4:
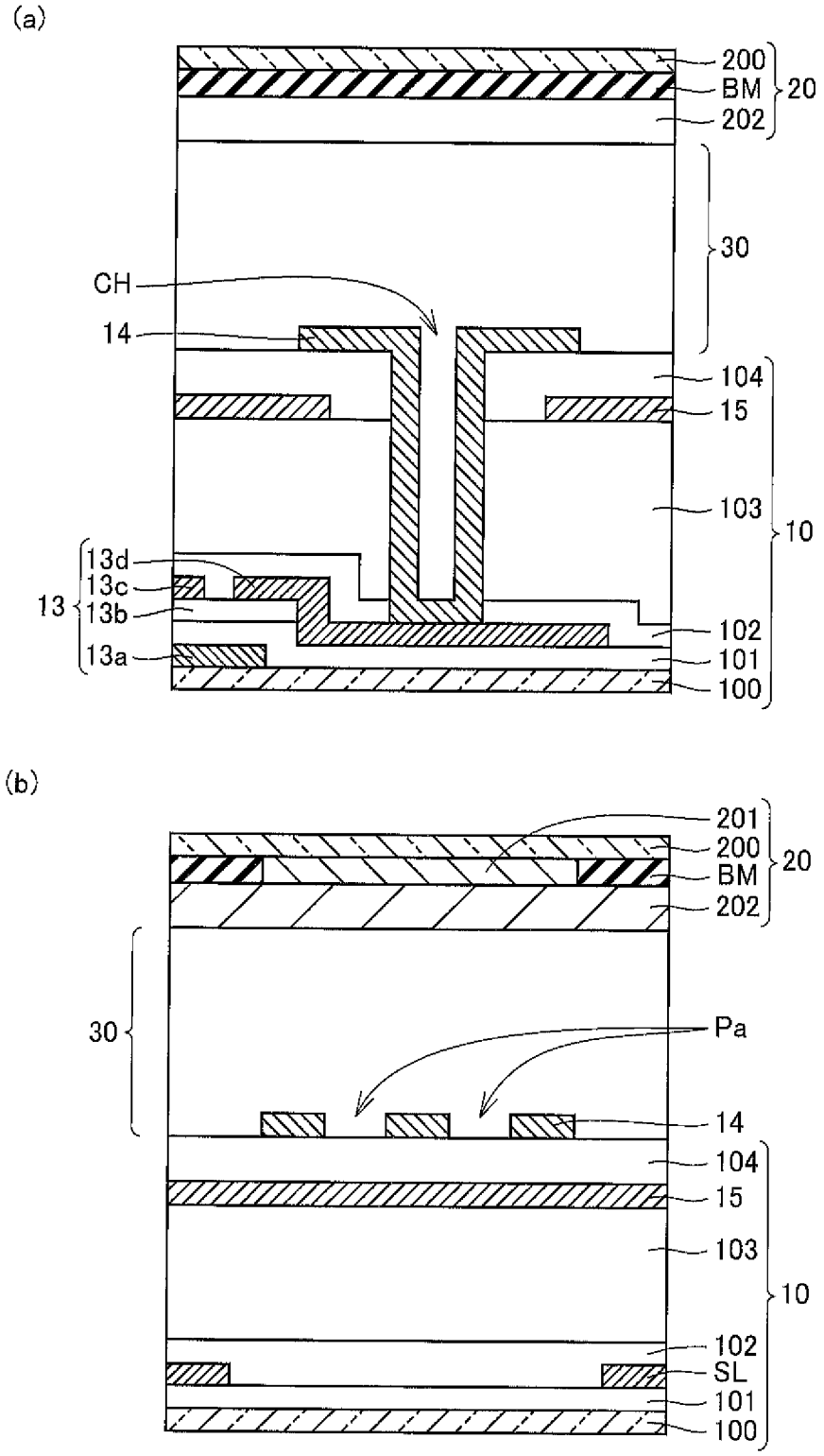
FIG. 4(*a*) of FIG. 4 is an A-A cross-sectional view of the display panel illustrated in FIG. 3, taken along the line A-A illustrated therein, and (*b*) of FIG. 4 is a B-B cross-sectional view of the display panel illustrated in FIG. 3, taken along the line B-B illustrated therein.

The following description describes the configuration of the subpixel more specifically. FIG. 3 is an enlarged plan view of some of the subpixels. FIG. 4 are cross-sectional views of the display panel 2 taken along a line A-A and a line B-B illustrated in FIG. 3 ((a): A-A cross section, (b): B-B cross section).

As illustrate in FIG. 3, the subpixel P includes a thin film transistor (TFT) 13, and a pixel electrode 14.

The TFT 13 is provided at a position at which the gate line GL and the source line SL intersect with each other, and connects the gate line GL and the source line SL with each other. Further, the TFT 13 is connected with the pixel electrode 14 through a contact hole CH.

The pixel electrode 14 is formed with, for example, a transparent conductive film made of ITO or the like. The pixel electrode 14 includes two slits Pa approximately parallel with the source lines SL. Though the illustration is omitted in FIG. 3, the active matrix substrate 10 is provided with a counter electrode 15 so that the counter electrode 15 is opposed to the pixel electrodes 14, as illustrated in FIG. 4. The counter electrode 15 is formed with, for example, a transparent conductive film made of ITO or the like. At a slit Pa provided in the pixel electrode 14, a horizontal electric field is formed between the pixel electrode 14 and the counter electrode 15, and drives the liquid crystal molecules.

At each subpixel P, an area outside a broken line frame, that is, an area that includes the gate line GL, the source line SL, the TFT 13, and a contact portion at which the pixel electrode 14 and the TFT 13 are connected, is covered with a black matrix BM (see FIG. 4) provided on the counter substrate 20. In other words, in the subpixel P illustrated in FIG. 3, an area inside the broken line frame PO is an area PO that allows light to pass therethrough and thereby contributes to display (hereinafter this area is referred to as an opening). In other words, in the present embodiment, the opening PO is an area through which light projected from the backlight (not shown) to the display panel passes without being blocked by the black matrix BM, opaque lines such as the gate lines GL, the source lines SL, and elements such as the TFTs 13.

While referring to FIG. 4, the following description specifically describes a cross section structure of the active matrix substrate 10 and the counter substrate 20.

As illustrated in (a) and (b) of FIG. 4, the active matrix substrate 10 has a gate electrode 13*a* of each TFT 13, and an insulating film 101 covering the gate electrode 13*a*, on a substrate 100 having translucency. As illustrated in (a) of FIG. 4, on the insulating film 101, there are provided a semiconductor layer 13*b* of each TFT 13, as well as a source electrode 13*c* and a drain electrode 13*d* that cover a part of the semiconductor layer 13*b*. Further, as illustrated in (b) of FIG. 4, on the insulating film 101, there is provided the source line SL.

As illustrated in (a) and (b) of FIG. 4, a passivation film 102 is provided so as to cover the source electrode 13*c* and the drain electrode 13*d*, as well as the source line SL, and on the passivation film 102, there is provided an organic insulating film 103. On the organic insulating film 103, the counter electrode 15 is provided, and a passivation film 104 is provided so as to cover the counter electrode 15.

As illustrated in (a) and (b) of FIG. 4, the pixel electrode 14 is provided on the passivation film 104. As illustrated in FIG. 4 (*a*), the pixel electrode 14 is connected with the drain electrode 13*d*, through the contact hole CH, which goes through the passivation film 104, the organic insulating film 103, and the passivation film 102.

As illustrated in (a) and (b) of FIG. 4, the counter substrate 20 has color filters 201 having colors of R, G, B arrayed in a predetermined order, on a substrate 200 having translucency. Each of the color filters 201 of R, G, and B is arranged so as to be opposed to the pixel electrode 14. The black matrix BM is provided at such a position that it does not overlap with the color filters 201. Further, as illustrated in (b) of FIG. 4, the counter substrate 20 has an overcoat layer 202 that does not cover the color filter 201 and the black matrix BM.

Figure 5:
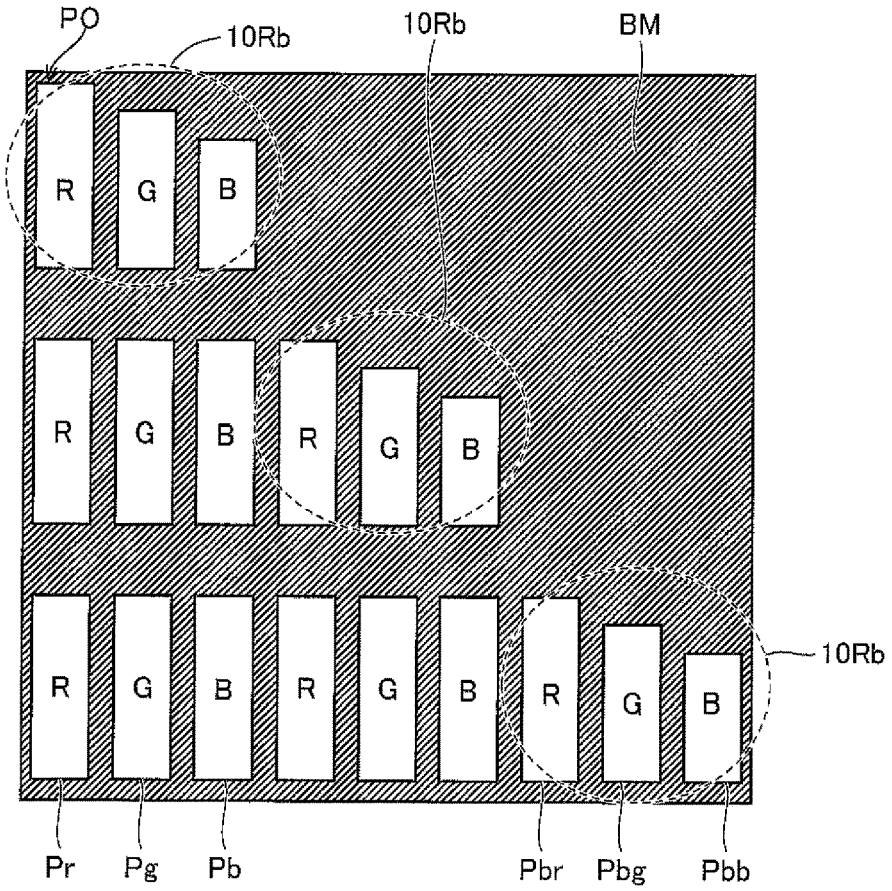
FIG. 5 illustrates openings of subpixels in a corner pixel region, and openings of subpixels in a non-boundary pixel region, illustrated in FIG. 2.

The following description describes an area of the opening in the subpixel P in the present embodiment, that is, an effective area in the subpixel P contributing display. FIG. 5 is a schematic view illustrating openings of some of the subpixels in a corner pixel region 10Rb illustrated in FIG. 2, and some of the subpixels in the non-boundary pixel region. Rectangles PO, denoted by any one of the characters of R, G, B, indicate openings of subpixels of any one of R, G, B. The subpixels corresponding to R, G, and B in the non-boundary pixel region are referred to as subpixels Pr, Pg, and Pb, respectively, and the subpixels corresponding to R, G, and B in the corner pixel region 10Rb are referred to as subpixel Pbr, Pbg, Pbb, respectively.

As illustrated in FIG. 5, among the pixels arranged in the corner pixel region 10Rb, the area of the opening of the subpixel Pbr is equal to that of each subpixel of the non-boundary pixel region, but the areas of the openings of the subpixels Pbg, Pbb are smaller than the area of the opening of each subpixel in the non-boundary pixel region Though the illustration is omitted, the subpixels of R, G, B in the corner pixel region 10Ra are arranged in the order of the subpixel Par of R, the subpixel Pag of G, and the subpixel Pab of B from the outer side of the display area 10R. In this case, the area of the opening of the subpixel Pab is equal to that of the subpixel in the non-boundary pixel region, and the areas of the openings of the subpixels Par, Pag are smaller than the area of the opening of the subpixel in the non-boundary pixel region.

In the case where the areas of the openings of the subpixels in the display area 10R are not uniform in this way, when it is intended to cause the subpixels of the same colors to display the same color (gray level), the application of the same gray level voltage to each subpixel causes differences in the transmittance among the subpixels, thereby causing brightness differences.

To cope with this, in the present embodiment, with respect to the pixels in the corner pixel region, gray level voltages are applied by the source driver 12 to the respective subpixels in such a manner that the subpixels having smaller areas of the openings have greater transmittances.

Figure 6:
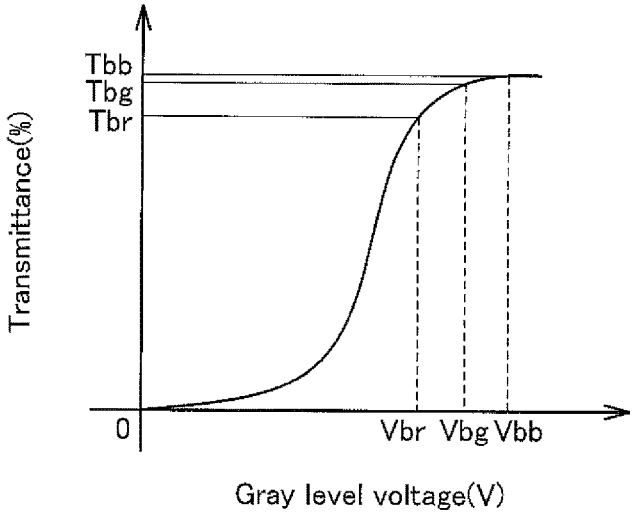
FIG. 6 illustrates the relationship between gray level voltages and transmittances during white color display, of subpixels of pixels in the corner pixel region in Embodiment 1.

FIG. 6 illustrates the relationship between gray level voltages and transmittances during white color display, of the subpixels of the pixels in the corner pixel region 10Rb. In this example, the configuration is such that as the gray level voltage is higher, the transmittance increases. Further, gray level voltage of the subpixels Pbr, Pbg, Pbb provided in the corner pixel region 10Rb during white color display are assumed to be Vbr, Vbg, and Vbb.

As illustrated in FIG. 6, in the present embodiment, the gray level voltages are set in such a manner that the gray level voltage Vbb of the subpixel Pbb having the smallest area of the opening is the highest, and the gray level voltage of the subpixel Pbr having the largest area of the opening is the lowest. With this setting, regarding the increasing/decreasing order of the transmittances, the transmittances Tbr, Tbg, Tbb of the subpixels Pbr, Pbg, Pbb during white color display satisfy Tbb>Tbg>Tbr.

FIG. 6 illustrates an example regarding the pixels in the corner pixel region 10Rb, and the same applies to the gray level voltages of the subpixels of the pixels in the corner pixel region 10Ra. More specifically, in a case where the gray level voltages of the subpixels Par, Pag, Pab of the pixel in the corner pixel region 10Ra during white color display are assumed to be Var, Vag, and Vab, respectively, the gray level voltages are set so as to satisfy Var>Vag>Vab. With this setting, regarding the increasing/decreasing order of the transmittances, the transmittances Tar, Tag, Tab of the subpixels Par, Pag, Pab satisfy Tar>Tag>Tab.

Figure 7A:
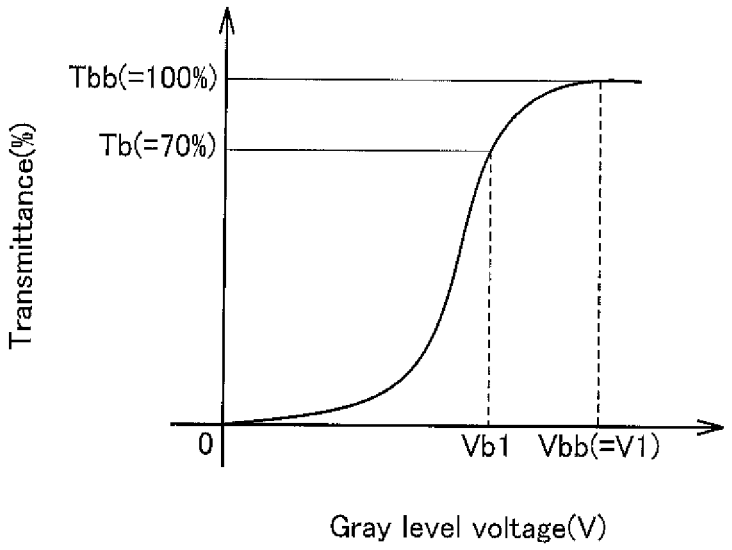
FIG. 7A illustrates the relationship between gray level voltages and transmittances of a subpixel of a pixel in the corner pixel region and a subpixel of a pixel in the non-boundary pixel region, during white color display in Embodiment 1.

The following description describes an exemplary setting of the gray level voltages in the corner pixel region and the non-boundary pixel region in the present embodiment. FIG. 7A illustrates the relationship between the gray level voltage and the transmittance of the subpixel Pbb in the corner pixel region 10Rb, and the relationship therebetween of the subpixel Pb in the non-boundary pixel region, during white color display. Further, FIG. 7B illustrates the relationship between gray level voltage and transmittance of a subpixel Pbb in the corner pixel region 10Rb, and the relationship therebetween of the subpixel Pb in the non-boundary pixel region, during halftone display.

In this example, the gray level voltage for the transmittance of 100% is assumed to be V1, and the gray level voltage for the transmittance of 50% is assumed to be V2 (V1>V2). For example, the ratio of the area of the opening of the subpixel Pbb with respect to the area of the opening of the subpixel Pb is assumed to be 70%. In this case, as illustrated in FIG. 7A, during white color display, the voltage V1 is applied as the gray level voltage Vbb to the subpixel Pbb so that the transmittance Tbb is 100%. On the other hand, here, to the subpixel Pb, the gray level voltage Vb1, which causes the subpixel Pb to have a transmittance Tb of about 70% of that of the subpixel Pbb, is applied.

Figure 7B:
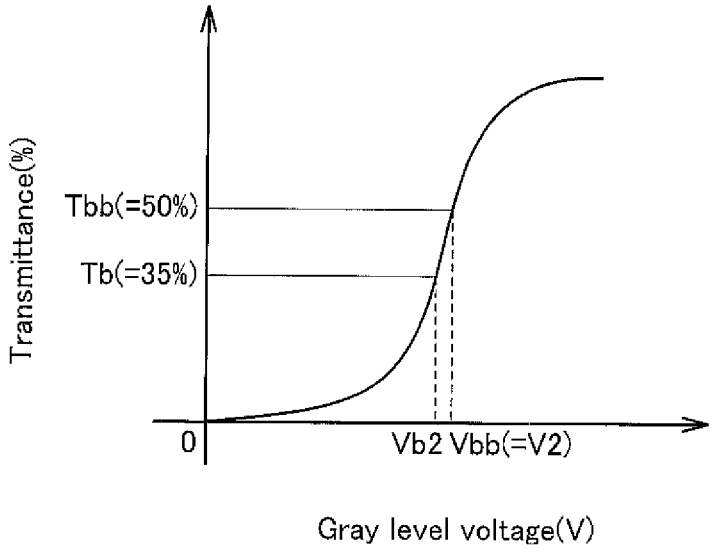
FIG. 7B illustrates the relationship between gray level voltages and transmittances of a subpixel of a pixel in the corner pixel region and a subpixel of a pixel in the non-boundary pixel region, during halftone display in Embodiment 1.

Likewise, in the case where the halftone display is performed, as illustrated in FIG. 7B, to the subpixel Pbb during halftone display, the voltage V2 is applied as the gray level voltage Vbb so that the transmittance Tbb is 50%. On the other hand, to the subpixel Pb, the gray level voltage Vb2 is applied so that the transmittance Tb is 70% of that of the subpixel Pbb, that is, the transmittance Tb is about 35%.

The configuration illustrated in FIGS. 7A, 7B is described with reference to an example of the relationship between the transmittances and the gray level voltages of the subpixel Pbb in the corner pixel region 10Rb and the subpixel Pb in the non-boundary pixel region, and this also applies to the relationship between transmittances and gray level voltages of the subpixel Pbg in the corner pixel region 10Rb and the subpixel Pg in the non-boundary pixel region, and the subpixels Par, Pag in the corner pixel region 10Ra and the subpixels Pr, Pg in the non-boundary pixel region.

In other words, in the present embodiment, the gray level voltage of the subpixel in the non-boundary pixel region is set according to the areas of the openings of the subpixels corresponding to the same color as that of the foregoing subpixel in the corner pixel regions 10Ra, 10Rb, the subpixels having smaller areas of the openings as compared with the foregoing subpixel. In other words, the gray level voltage of the subpixel in the non-boundary pixel region is set based on the ratio between the area of the opening of the foregoing subpixel, and the areas of the openings of the subpixels corresponding to the same color as that of the foregoing subpixel in the corner pixel regions 10Ra, 10Rb.

Additionally, it is preferable that the gray level voltage of the subpixel in the non-boundary pixel region is set so that the subpixel in the non-boundary pixel region and the subpixels in the corner pixel region 10Ra, 10Rb corresponding to the same color as that of the foregoing subpixel have the same brightness, though this is not necessarily essential. A difference at an invisible level is tolerable between the brightness of the subpixel in the non-boundary pixel region, and the brightness of the subpixels in the corner pixel regions 10Ra, 10Rb corresponding to the same color as that of the foregoing subpixel. More specifically, for example, the difference between the gray level of the subpixel in the non-boundary pixel region, and the gray level of the subpixels in the corner pixel region 10Ra, 10Rb corresponding to the same color as that of the foregoing subpixel may be within one gray level. Further, the difference between the transmittance of the subpixel in the non-boundary pixel region and the transmittance of the subpixels in the corner pixel regions 10Ra, 10Rb corresponding to the same color as that of the foregoing subpixel may be, for example, within 10% depending on the variation at the time of the manufacture of the color filters 201.

In the above-described embodiment, the transmittance of the subpixel in the non-boundary pixel region is set to be smaller than that of the subpixel in the corner pixel region that corresponds to the same color as that of the foregoing subpixel and that has a smaller area of the opening. With this configuration, for example, when white color display is performed, the brightness difference between the pixel in the corner pixel region and the pixel in the non-boundary pixel region is reduced. Consequently, color balance is hardly lost between pixels in the corner pixel region and those in the non-boundary pixel region, and deterioration of the display quality such as defective coloring and the like is reduced.

Embodiment 2

Embodiment 1 is described with reference to an exemplary case where the area of each opening of some of subpixels in the corner pixel region is smaller than the area of the opening of the subpixel in the non-boundary pixel region. The present embodiment is described with reference to a case where the area of each opening of some of subpixels in the corner pixel region is greater than the area of the opening of the subpixel in the non-boundary pixel region.

Figure 8:
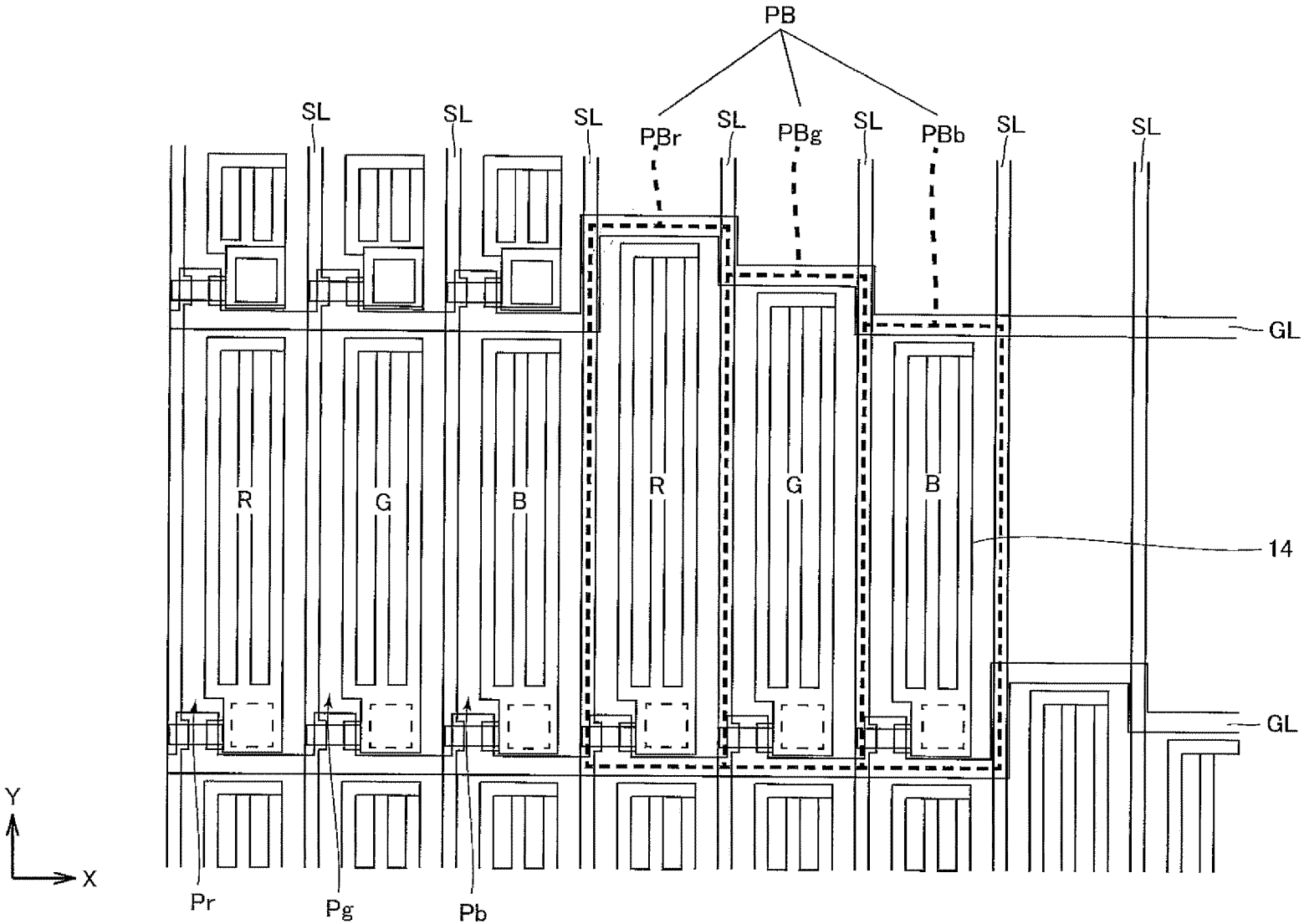
FIG. 8 is an enlarged schematic diagram illustrating subpixels of pixels in a part of a non-boundary pixel region and a part of a corner pixel region in Embodiment 2.

FIG. 8 is an enlarged schematic diagram illustrating some of pixels in the non-boundary pixel region and some of pixels in the corner pixel region 10Rb illustrated in FIG. 2. In FIG. 8, the same configurations as those in Embodiment 1 are denoted by the same reference symbols as those in Embodiment 1.

In FIG. 8, a pixel PB indicated by broken line frames is a pixel in the corner pixel region 10Rb in the present embodiment. The pixel PB is composed of subpixels PBr, PBg, and PBb corresponding to R, G, and B, respectively.

As illustrated in FIG. 8, X-axis-direction lengths of the subpixels and the pixel electrodes 14 in the corner pixel region and those in the non-boundary pixel region are equal, respectively, but the lengths thereof in the Y axis direction are different. More specifically, the Y-axis-direction lengths of the subpixels PBr, PBg are greater than those of the subpixels Pr, Pg, and the Y-axis-direction length of the pixel electrode 14 of the subpixels PBr, PBg are greater than those of the subpixels Pr, Pg. On the other hand, the Y-axis-direction length of the subpixel PBb in the boundary pixel region and that of the subpixel Pb in the non-boundary pixel region are equal to each other, and so are the Y-axis-direction length of the pixel electrode 14 of the subpixel PBb in the boundary pixel region and that of the subpixel Pb in the non-boundary pixel region.

Figure 9:
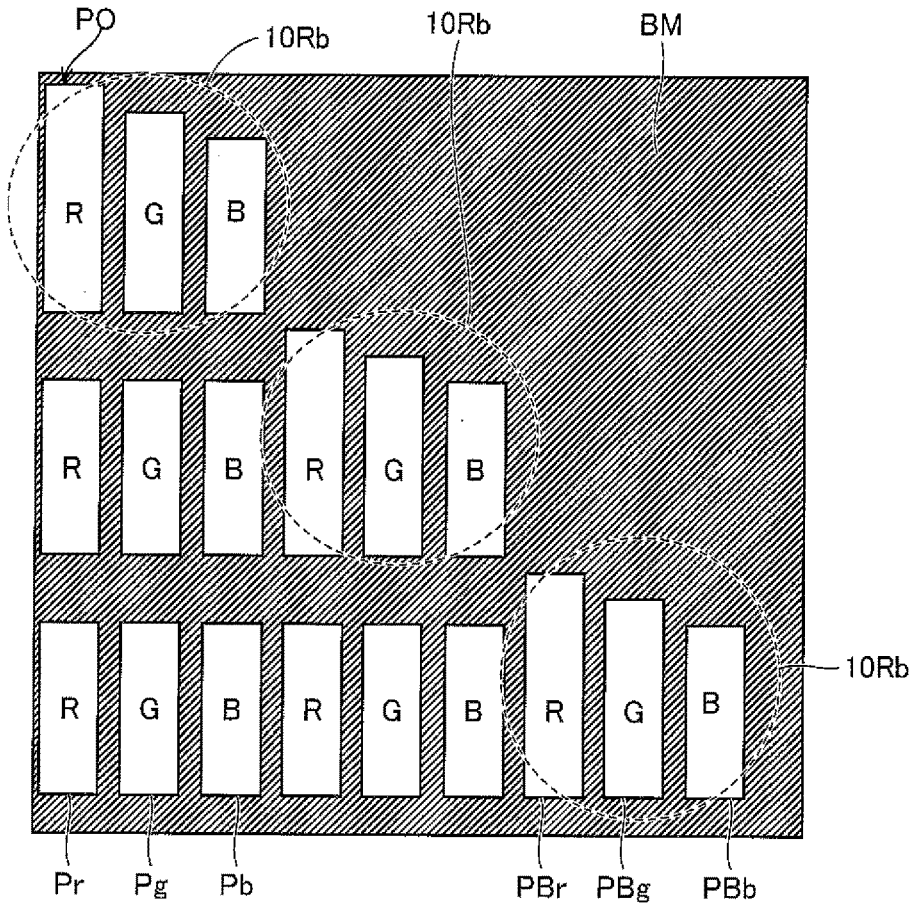
FIG. 9 illustrates openings of subpixels in a corner pixel region, and openings of subpixels in a non-boundary pixel region, illustrated in FIG. 8.

Here, the following description describes the area of the opening of the subpixel in the corner pixel region 10Rb, and that of the subpixel in the non-boundary pixel region in the present embodiment. FIG. 9 illustrates openings PO of subpixels in the corner pixel region and subpixels in the non-boundary pixel region in the present embodiment.

As illustrated in FIG. 9, the area of the opening of the subpixel PBr in the corner pixel region 10Rb is larger than that of the subpixel Pr in the non-boundary pixel region, and the area of the opening of the subpixel PBg in the corner pixel region 10Rb is larger than that of the subpixel Pg in the non-boundary pixel region. On the other hand, the area of the opening of the subpixel PBb in the corner pixel region 10Rb, and that of the subpixel Pb in the non-boundary pixel region, are equal to each other.

Figure 10:
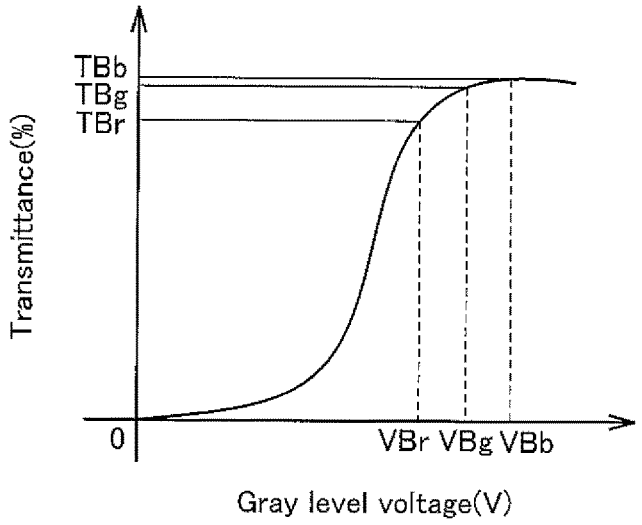
FIG. 10 illustrates the relationship between gray level voltages and transmittances during white color display, of subpixels of pixels in the corner pixel region illustrated in FIG. 8.

In the present embodiment, as is the case with Embodiment 1 described above, for example, when white color is displayed, gray level voltages are applied by the source driver 12 to the subpixels in such a manner that the subpixels having smaller areas of the openings have greater transmittances. The gray level voltages of the subpixels PBr, PBg, PBb during white color display are assumed to be VBr, VBg, and VBb, respectively. Here, as illustrated in FIG. 10, the gray level voltages are set in such a manner that the gray level voltage VBb of the subpixel PBb having the smallest area of the opening is the highest, and the gray level voltage VBr of the subpixel PBr having the largest area of the opening is the lowest. With this setting, regarding the increasing/decreasing order of the transmittances, the transmittances TBr, TBg, TBb of the subpixels PBr, PBg, PBb during white color display satisfy TBb>TBg>TBr.

FIG. 9 illustrates exemplary pixels in the corner pixel region 10Rb, and this concept applies to the gray level voltages of the subpixels of the pixels in the corner pixel region 10Ra. Though the illustration is omitted, in the case of the corner pixel region 10Ra, regarding the pixels arranged in the corner pixel region 10Ra, the areas of the openings thereof decrease in the order of the subpixel PAb corresponding to B, the subpixel PAg corresponding to G, and the subpixel PAr corresponding to R. The gray level voltages are set in such a manner that the respective gray level voltages VAr, VAg, and VAb of the subpixels PAr, PAg, and PAb during white color display satisfy VAr>VAg>VAb. With this setting, regarding the increasing/decreasing order of the transmittances, the transmittances TAr, TAg, TAb of the subpixels PAr, PAg, PAb satisfy TAr>TAg>TAb.

Figure 11A:
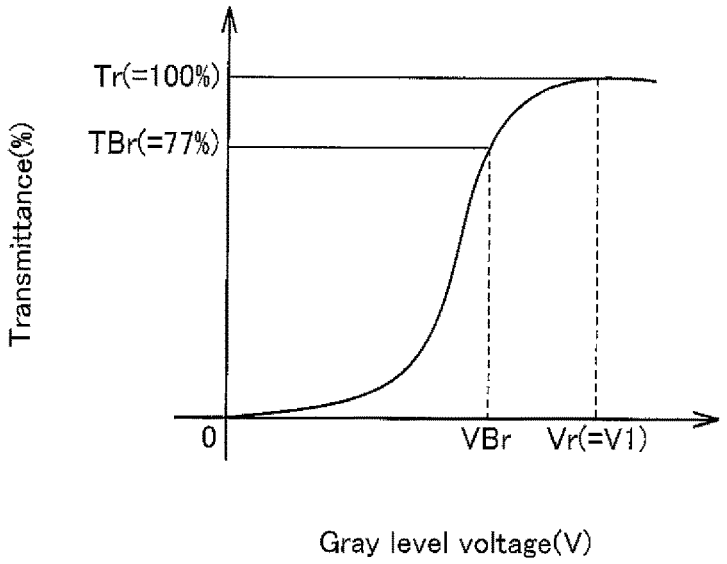
FIG. 11A illustrates the relationship between gray level voltages and transmittances of subpixels of pixels in the corner pixel region and subpixels of pixels in the non-boundary pixel region, during white color display in Embodiment 2.

Here, the following description describes an exemplary setting of the gray level voltages for the corner pixel region and the non-boundary pixel region in the present embodiment. FIG. 11A illustrates the relationship between gray level voltages and transmittances of subpixels PBr in the corner pixel region 10Rr and subpixels Pr in the non-boundary pixel region, during white color display. Further, FIG. 11B illustrates the relationship between gray level voltages and transmittances of subpixels PBr in the corner pixel region 10Rb and subpixels Pr in the non-boundary pixel region during halftone display.

In this example, as is the case with Embodiment 1 described above, the gray level voltage for the transmittance of 100% is assumed to be V1, and the gray level voltage for the transmittance of 50% is assumed to be V2 (V1>V2). Further, in this example, the ratio of the area of the opening of the subpixel PBr to the area of the opening of the subpixel Pr is assumed to be 130%

In this case, as illustrated in FIG. 11A, during white color display, the voltage V1 is applied as the gray level voltage Vr to the subpixel Pr so that the transmittance Tr is 100%. On the other hand, here, to the subpixel PBr, the gray level voltage VBr, which causes the subpixel PBr to have a transmittance TBr of about 77% (=100÷130×100) of that of the subpixel Pr, is applied.

Figure 11B:
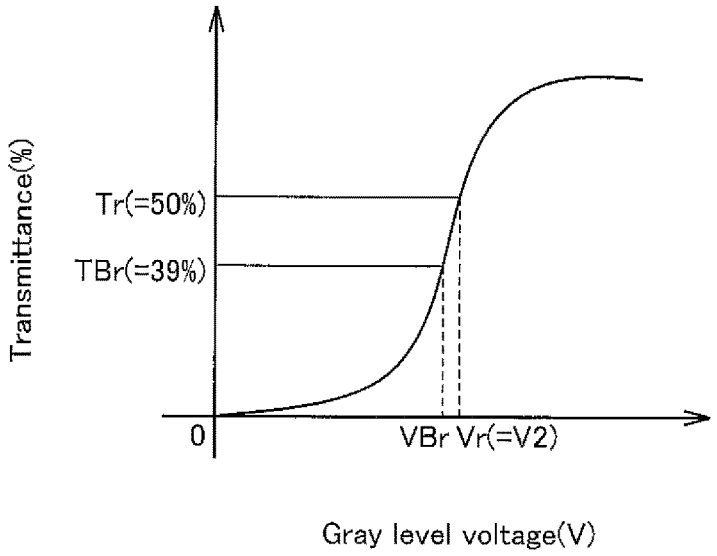
FIG. 11B illustrates the relationship between gray level voltages and transmittances of subpixels of pixels in the corner pixel region and subpixels of pixels in the non-boundary pixel region during halftone display in Embodiment 2.

Likewise, in the case where the halftone display is performed, as illustrated in FIG. 11B, to the subpixel Pr, the voltage V2 is applied as the gray level voltage Vr so that the transmittance Tr is 50%. On the other hand, to the subpixel PBr, the gray level voltage VBr is applied so that the transmittance TBr is 77% of that of the subpixel Pr, that is, the transmittance TBr is about 39%.

The configuration illustrated in FIGS. 11A, 11B is described with reference to an example of the relationship between the transmittances and the gray level voltages of the subpixel PBr in the corner pixel region 10Rb and the subpixel Pr in the non-boundary pixel region, and this also applies to the relationship between transmittances and gray level voltages of the subpixel PBg in the corner pixel region 10Rb and the subpixel Pg in the non-boundary pixel region, and the subpixels PAb, PAg in the corner pixel region 10Ra and the subpixels Pb, Pg in the non-boundary pixel region.

In the above-described embodiment, the area of each opening of some of subpixels in the corner pixel region is greater than the area of the opening of the subpixel in the non-boundary pixel region. Then, the gray level voltage is set so that the transmittance of some of the subpixels in the corner pixel region is smaller than that of the subpixels of the same color as that of the foregoing subpixel in the non-boundary pixel region. This causes, for example, during white color display, the brightness of the subpixel of the pixel arranged in the corner pixel region and the brightness of the subpixel of the pixel arranged in the non-boundary pixel region to be equal to each other. Consequently, color balance is hardly lost between pixels in the corner pixel region and those in the non-boundary pixel region, and deterioration of the display quality such as defective coloring and the like is reduced. Further, in the above-described embodiment, since the transmittance of the subpixel in the non-boundary pixel region is greater than that of the subpixel in the corner pixel region, the transmittance of the display panel as a whole can be increased as compared with Embodiment 1.

The display device according to the present invention is as described above. The display device according to the present invention, however, is not limited to the configuration of the above-described embodiment, and may have any one of a variety of modification configurations.

Figure 12:
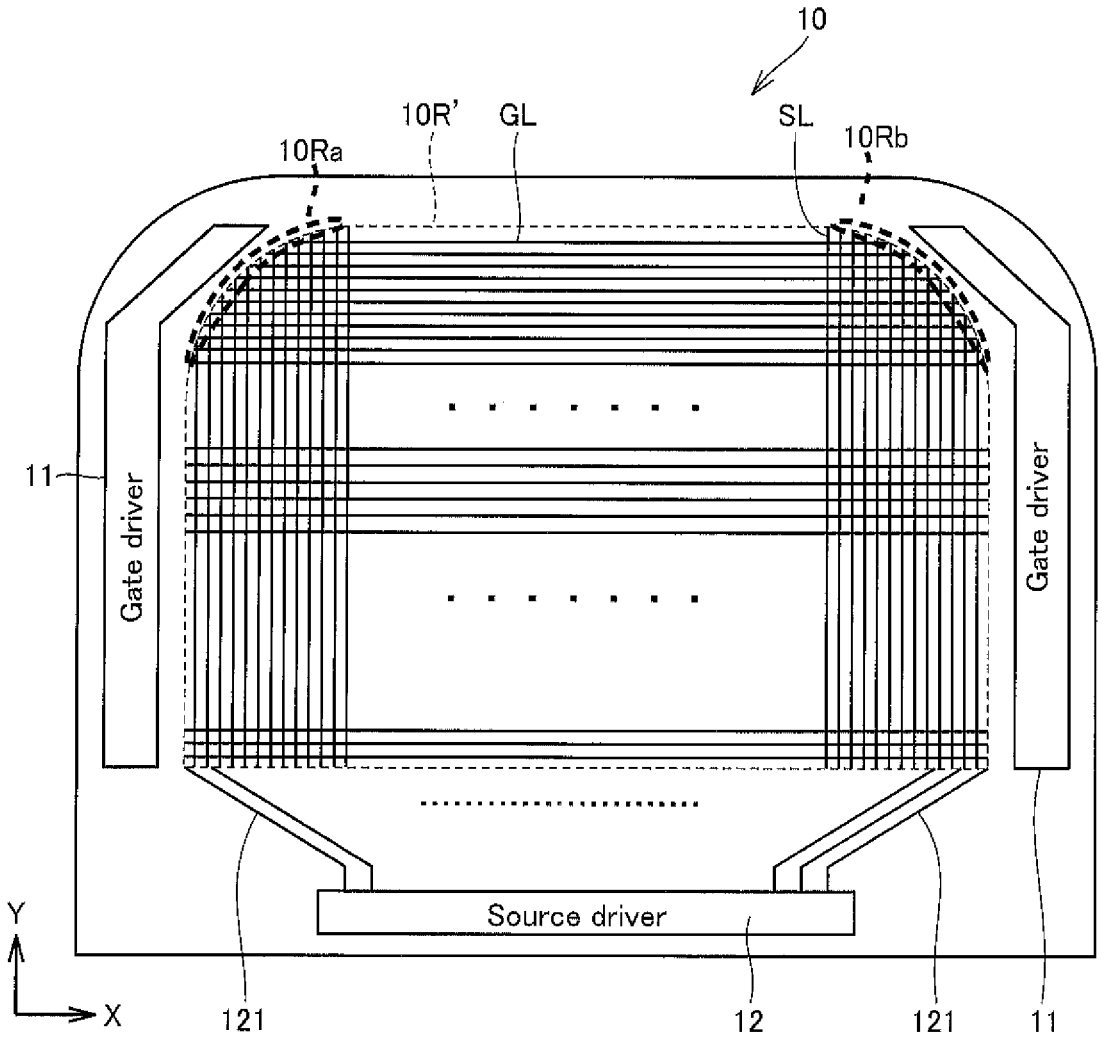
FIG. 12 is a plan view illustrating a schematic configuration of an active matrix substrate according to Modification Example 1.

(1) In the above-described embodiments, sides extended between the short side of the active matrix substrate 10 parallel to the X axis and the two sides parallel to the Y axis are straight, but as illustrated in FIG. 12, they may be in circular arc shapes. Further, the display area 10R' of the active matrix substrate 10 may be formed in the same shape as the outer shape of the active matrix substrate 10.

(2) The above-described embodiments are described with reference to an exemplary display device in which liquid crystal used, but the display device may be a display device in which organic electroluminescence (EL). In this case, gray-level-indicating current values for the subpixels are set according to the ratio of the display-contributing effective area of the subpixel in the corner pixel region to that of the subpixel in the non-boundary pixel region, that is, the ratio of the light emission areas of the subpixels.

(3) The above-described embodiments are described with reference to an example in which one pixel is composed of three subpixels of R, G, and B, but the configuration may be such that, for example, one pixel is composed of four or more subpixels, such as subpixels of R, G, B, and Y (yellow), or subpixels of R, G, B, and W (white).

(4) In the above-described embodiments, each opening PO of the subpixel of the boundary pixel is in a rectangular shape, but it may be in a non-rectangular shape. For example, in a case where a part of the boundary of the display area is in a circular arc shape, the subpixel of the boundary pixel may be covered with the black matrix BM in such a manner that the opening PO of the subpixel has an end in a circular arc shape (5) The above-described embodiments are described with reference to an exemplary case where the effective areas of the subpixels are not uniform in the non-rectangular-shape display area, but the above-described configuration may be applied to a case where the effective areas of the subpixels are not uniform in the rectangular-shape display area. For example, in a case where spaces for adjusting the cell thickness are provided in a part of a rectangular-shape display area, the area of the black matrix BM covering the spacers is set to be greater than the spacer diameter in order to prevent light leakage around the spacers. This causes the openings of the subpixels where the spacers are provided to be smaller than the openings of the other subpixels corresponding to the same color as that of the foregoing subpixels. In other words, the subpixels provided with the spacers have different effective areas from those of the other pixels. In this case, by the same method as that in Embodiment 1 described above, the gray level voltages for the subpixels not provided with the spacers are controlled so that the brightness difference between the subpixels provided with the spacers and the other subpixels is reduced, whereby the transmittance is adjusted. With this configuration, even if white color display is performed, defective coloring hardly occurs at the subpixels provided with the spacers and the subpixels provided with no spacers that correspond to the same color.

(6) The above-described embodiments are described with reference to an example in which the outer shape of the display area is in a non-rectangular shape, but the configuration may be such that the display area, for example, has an outer shape in a rectangular shape and there is a circular hole or the like inside the display area. In this case, subpixels around the hole, in other words, subpixels superposed on the outer edge of the hole, have smaller openings than those of the other subpixels corresponding to the same color as that of the foregoing subpixels. In this case, therefore, by the same method as that in Embodiment 1 described above, the gray level voltages for the other subpixels are controlled so that the brightness difference between the subpixels around the hole and the other subpixels is reduced, whereby the transmittance is adjusted.

DESCRIPTION OF REFERENCE NUMERALS

1: display device
2: display panel
10: active matrix substrate
10Ra, 10Rb: corner pixel region
11: gate driver
12: source driver
13: TFT
14: pixel electrode
15: counter electrode (common electrode)
20: counter substrate
30: liquid crystal layer
201: color filter
BM: black matrix
GL: gate line
SL: source line

The invention claimed is:

1. A display device comprising:

a display panel including a display area in a non-rectangular shape; and a driver that supplies gray level signals to the display panel, the gray level signals indicating gray levels of an image to be displayed in the display area, wherein the display area includes:

a pixel group in which a plurality of pixels are arrayed, each pixel including subpixels corresponding to at least three different colors, respectively; and a plurality of data lines that supply the gray level signals to the subpixels of the pixel group, respectively, wherein the pixel group includes a plurality of boundary pixels provided at a boundary of the display area, and a plurality of non-boundary pixels provided in an area other than the boundary, a display-contributing effective area of one of the subpixels of one of the colors in the boundary pixels, is different from a display-contributing effective area of one of the subpixels of one of the colors in the non-boundary pixels, and the driver supplies the gray level signals for the one of the subpixels of the one of the colors in the boundary pixels to the corresponding data line, based on a ratio of the display-contributing effective area of the one of the subpixels of the one of the colors in the non-boundary pixels to the display-contributing effective area of the one of the subpixels of the one of the colors in the boundary pixels.

2. The display device according to claim 1, wherein the display-contributing effective area of the one of the subpixels of the one of the colors in the boundary pixels is smaller than the display-contributing effective area of the one of the subpixels of one of the colors in the non-boundary pixels, and when causing the one of the subpixels of the one of the colors in the boundary pixels, and the one of the subpixels of the one of the colors in the non-boundary pixels, to display an image of a same color, the driver supplies the gray level signals so that the one of the subpixels of the one of the colors in the non-boundary pixels has a brightness lower than a brightness of the one of the subpixels of the one of the colors in the boundary pixels.

3. The display device according to claim 1, wherein the display-contributing effective area of the one of the subpixels of the one of the colors in the boundary pixels is larger than the display-contributing effective area of the one of the subpixels of the one of the colors in the non-boundary pixels, and when causing the one of the subpixels of the one of the colors in the boundary pixels, and the one of the subpixels of the one of the colors in the non-boundary pixels, to display an image of a same color, the driver supplies the gray level signals so that the one of the subpixels of the one of the colors in the boundary pixels has a brightness lower than a brightness of the one of the subpixels of the one of the colors in the non-boundary pixels.

4. The display device according to claim 1, wherein, when causing the one of the subpixels of the one of the colors in the boundary pixels, and the one of the subpixels of the one of the colors in the non-boundary pixels to display a same color, the driving driver supplies the gray level signals so that a brightness difference between the one of the respective subpixels of the one of the colors in boundary pixels and the one of the subpixels of the one of the colors in the non-boundary pixels is within a predetermined range.

5. The display device according to claim 1, wherein the display panel includes a liquid crystal layer in the pixel group.

* * * * *